US007998098B2

(12) United States Patent
Yang

(10) Patent No.: US 7,998,098 B2
(45) Date of Patent: Aug. 16, 2011

(54) MASSAGING APPARATUS

(76) Inventor: Tsung-Hsun Yang, Taichung Hsien (TW)

( * ) Notice: Subject to any disclaimer, the term of this patent is extended or adjusted under 35 U.S.C. 154(b) by 1001 days.

(21) Appl. No.: 11/857,094

(22) Filed: Sep. 18, 2007

(65) Prior Publication Data

US 2008/0039751 A1 Feb. 14, 2008

(51) Int. Cl.
*A61H 7/00* (2006.01)
*A61H 19/00* (2006.01)

(52) U.S. Cl. ..... 601/134; 601/90

(58) Field of Classification Search ..... 601/24, 601/49, 84, 86, 90, 98, 134; 606/240–242
See application file for complete search history.

(56) References Cited

U.S. PATENT DOCUMENTS 3,403,674 A * 10/1968 Alimanestiano ..... 601/134
4,041,938 A * 8/1977 Wintoniw ..... 601/101
4,984,568 A * 1/1991 Persaud ..... 601/122
5,016,617 A * 5/1991 Tarlow et al. ..... 601/117
5,582,582 A * 12/1996 Chapman ..... 601/112
5,916,182 A * 6/1999 Fengler ..... 601/110
6,283,929 B1 * 9/2001 Mjehovic ..... 601/136
2004/0193077 A1 * 9/2004 Hsu et al. ..... 601/49

* cited by examiner

*Primary Examiner* — Kristen C Matter
(74) *Attorney, Agent, or Firm* — Abelman, Frayne & Schwab

(57) ABSTRACT

A massaging apparatus includes a control unit for controlling first to third drive units so as to drive movement of a second guiding rail unit along a first guiding rail unit in a transverse direction, movement of a mounting seat on the second guiding rail unit in a longitudinal direction, and movement of a post on the mounting seat in a vertical direction such that a massage member mounted on a bottom end of the post is moved to contact a user's body that lies on a bed body at a desired acupuncture point. Thereafter, the control unit further controls the third drive unit so as to drive further downward movement of the post corresponding to a desired massage pressure, and controls the first and second drive units so as to drive movement of the massage member around the desired acupuncture point of the user's body.

9 Claims, 9 Drawing Sheets

MASSAGING APPARATUS

BACKGROUND OF THE INVENTION

1. Field of the Invention

The invention relates to a massaging apparatus, more particularly to a massaging apparatus that has a massage member movable in transverse, longitudinal and vertical directions.

2. Description of the Related Art

FIG. 1 illustrates a conventional massage chair 1 that includes a chair body 12, a plurality of massage members 13 and a control unit 11. The chair body 12 has a back portion 122, a seat portion 121, and a footrest 123 disposed in front of the seat portion 121. The massage members 13 are mounted in the back portion 122, the seat portion 121 and the footrest 123, and are controlled by the control unit 11.

However, since the positions of the massage members 13 mounted in the seat portion 121 and the footrest 123 are fixed, massagable areas for hips and legs of a user are limited.

SUMMARY OF THE INVENTION

Therefore, the object of the present invention is to provide a massaging apparatus that can overcome the aforesaid drawback of the prior art.

According to the present invention, a massaging apparatus comprises:

a bed unit having a main frame, and a rectangular bed body mounted on the main frame, the main frame including a first guiding rail unit disposed above the bed body and having opposite elongate lateral rail rods spaced apart from each other in a transverse direction, a second guiding rail unit mounted slidably on the first guiding rail unit and including two parallel elongate second rail rods that extend between the lateral rail rods of the first guiding rail unit and that are spaced apart from each other in a longitudinal direction perpendicular to the transverse direction, a mounting seat mounted slidably on the second rail rods of the second guiding rail unit, and a post extending through and mounted movably on the mounting seat such that the post is movable relative to the mounting seat in a vertical direction perpendicular to the transverse direction and the longitudinal direction, the post having a bottom end provided with a massage member that is adapted to contact a user's body lying on the bed body;

a first drive unit mounted on the main frame of the bed unit for driving the second guiding rail unit to move along the lateral rail rods in the longitudinal direction;

a second drive unit mounted on the second guiding rail unit for driving the mounting seat to move along the second rail rods in the transverse direction;

a third drive unit mounted on the mounting seat for driving the post to move in the vertical direction; and a control unit connected electrically to the first, second and third drive units, and controlling the first, second and third drive units so as to drive movement of the second guiding rail unit in the longitudinal direction, movement of the mounting seat in the transverse direction, and movement of the post in the vertical direction such that the massage member is moved to contact the user's body at a desired acupuncture point.

After the massage member contacts the user's body, the control unit further controls the third drive unit so as to drive further downward movement of the post, thereby pressing the massage member against the user's body at the desired acupuncture point, and controls the first and second drive units so as to drive movement of the massage member around the desired acupuncture point of the user's body such that the user's body is massaged by the massage member with a desired massage pressure corresponding to further downward movement of the post.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
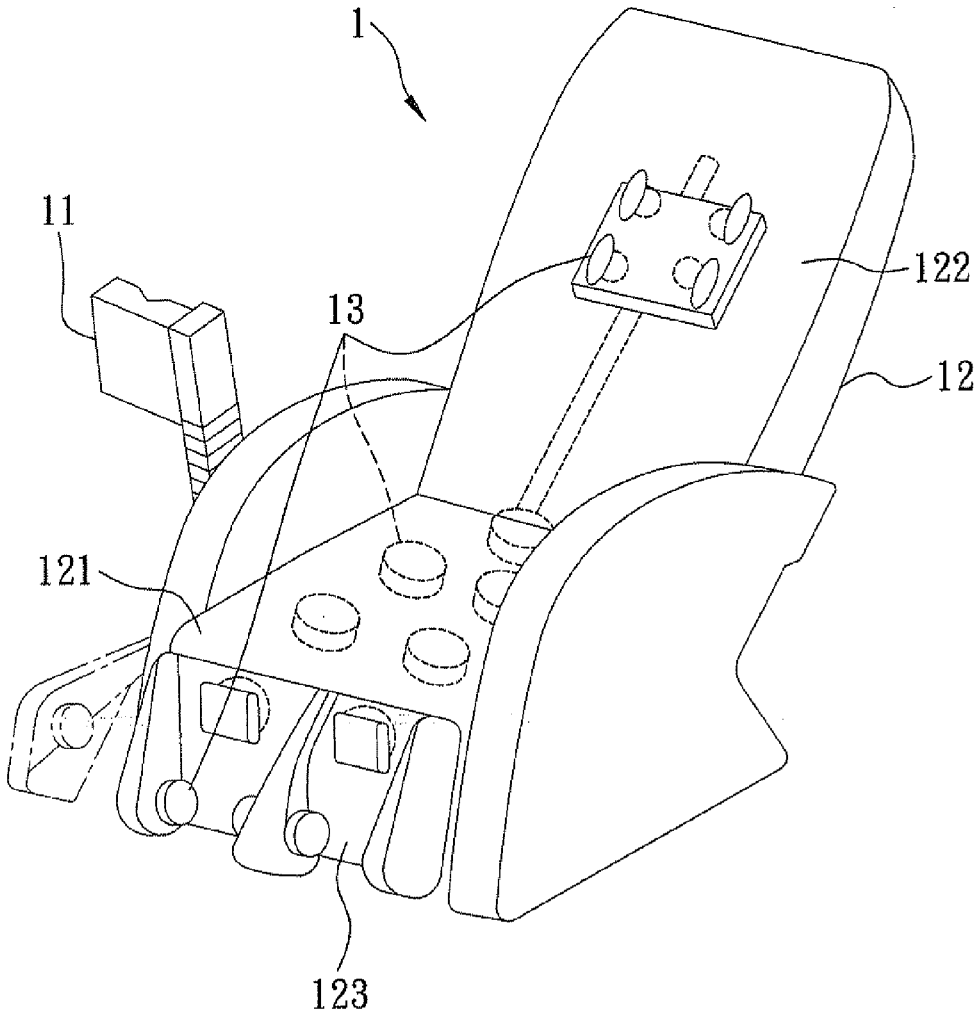
FIG. 1 PRIOR ART
FIG. 1 is a perspective view of a conventional massage chair.
Figure 2:
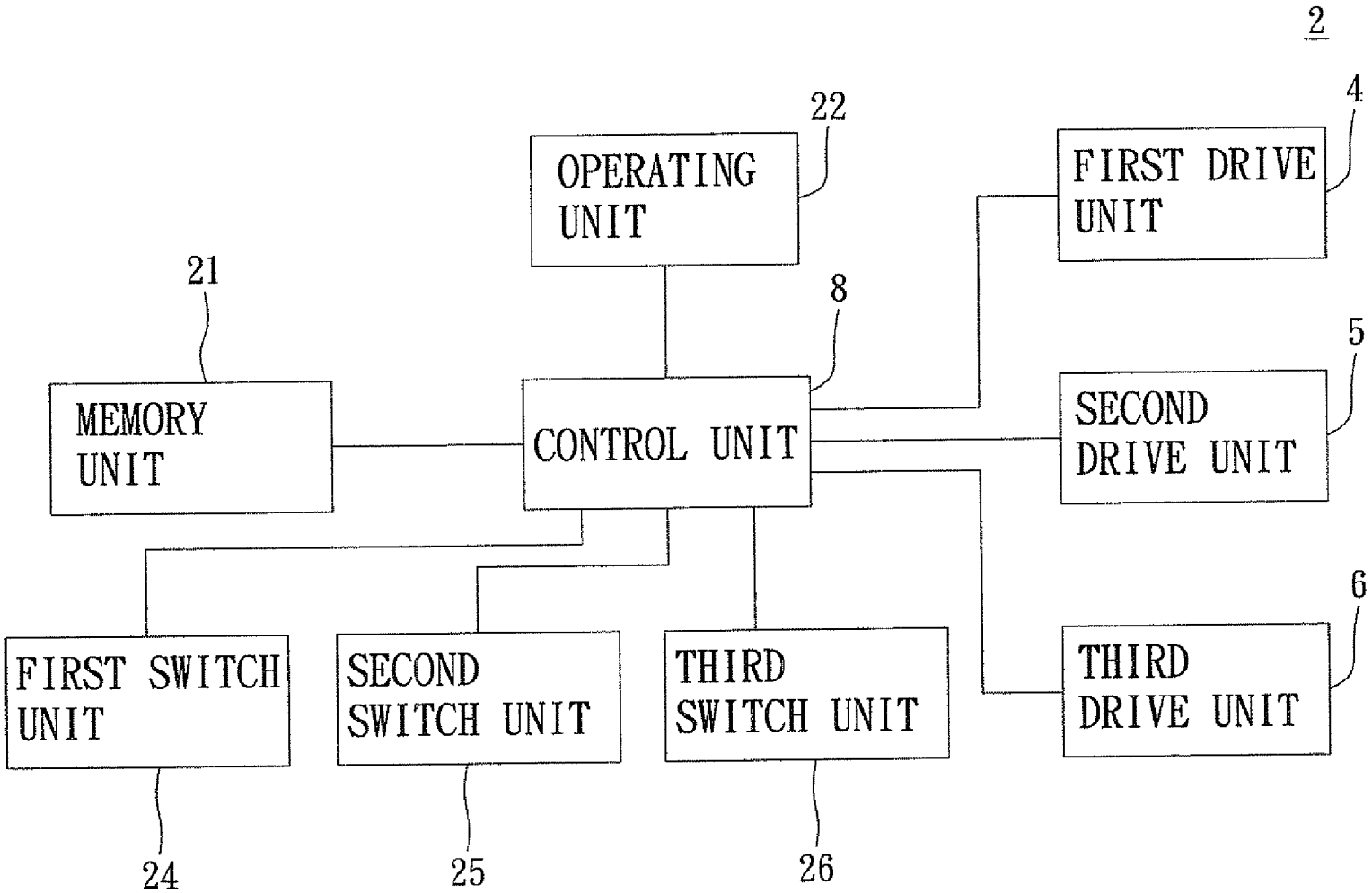
FIG. 2 is a schematic circuit block diagram illustrating the preferred embodiment of a massaging apparatus according to the present invention.

Referring to FIGS. 2 to 6, the preferred embodiment of a massaging apparatus 2 according to the present invention is shown to include a bed unit 3, a first drive unit 4, a second drive unit 5, a third drive unit 6, a memory unit 21, an operating unit 22, a control unit 8, a first switch unit 24, a second switch unit 25, and a third switch unit 26.

Figure 3:
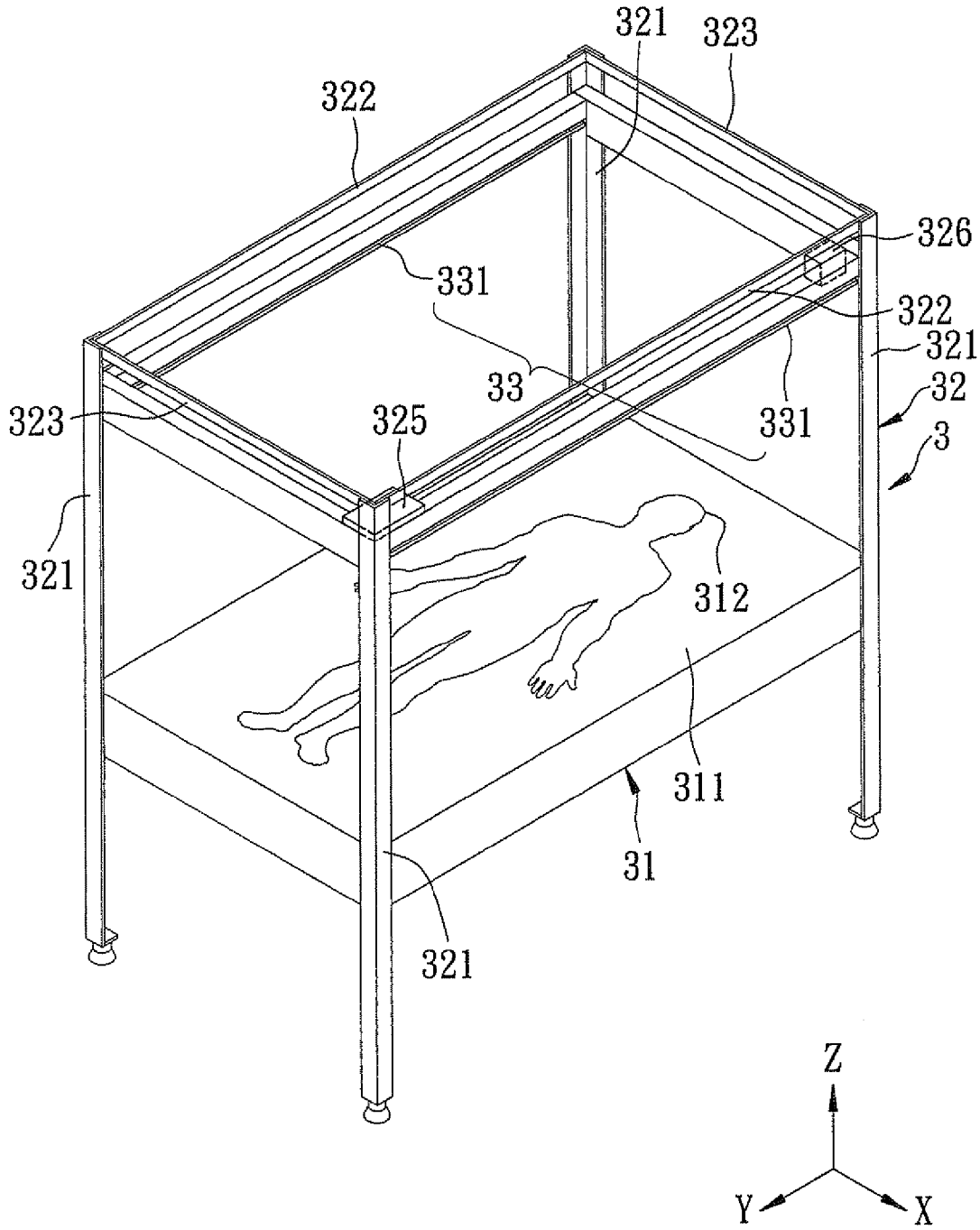
FIG. 3 is a perspective view showing a bed unit of the preferred embodiment without a second guiding rail unit, a mounting seat and a post.
Figure 4:
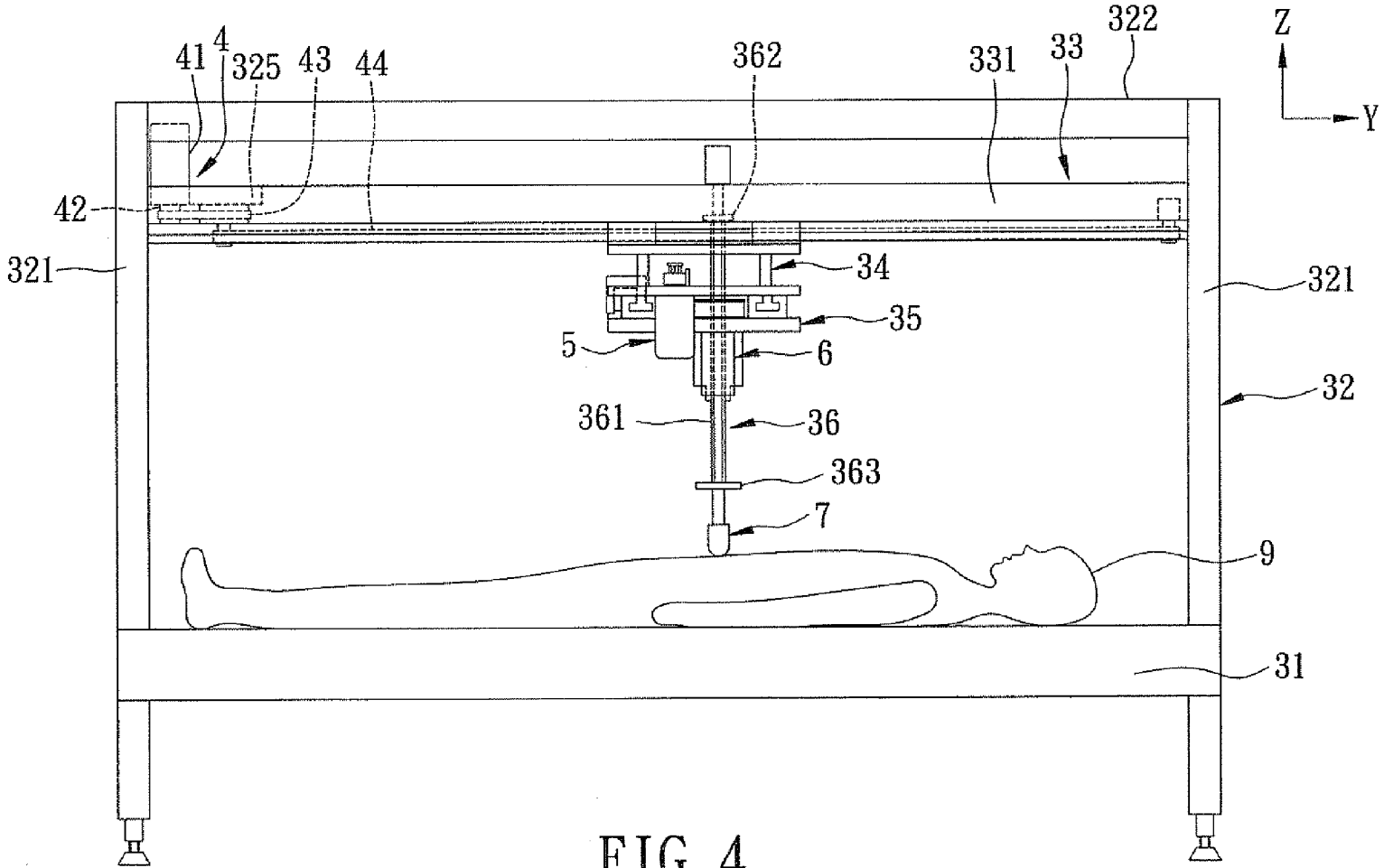
FIG. 4 is a schematic side view showing the preferred embodiment.
Figure 9:
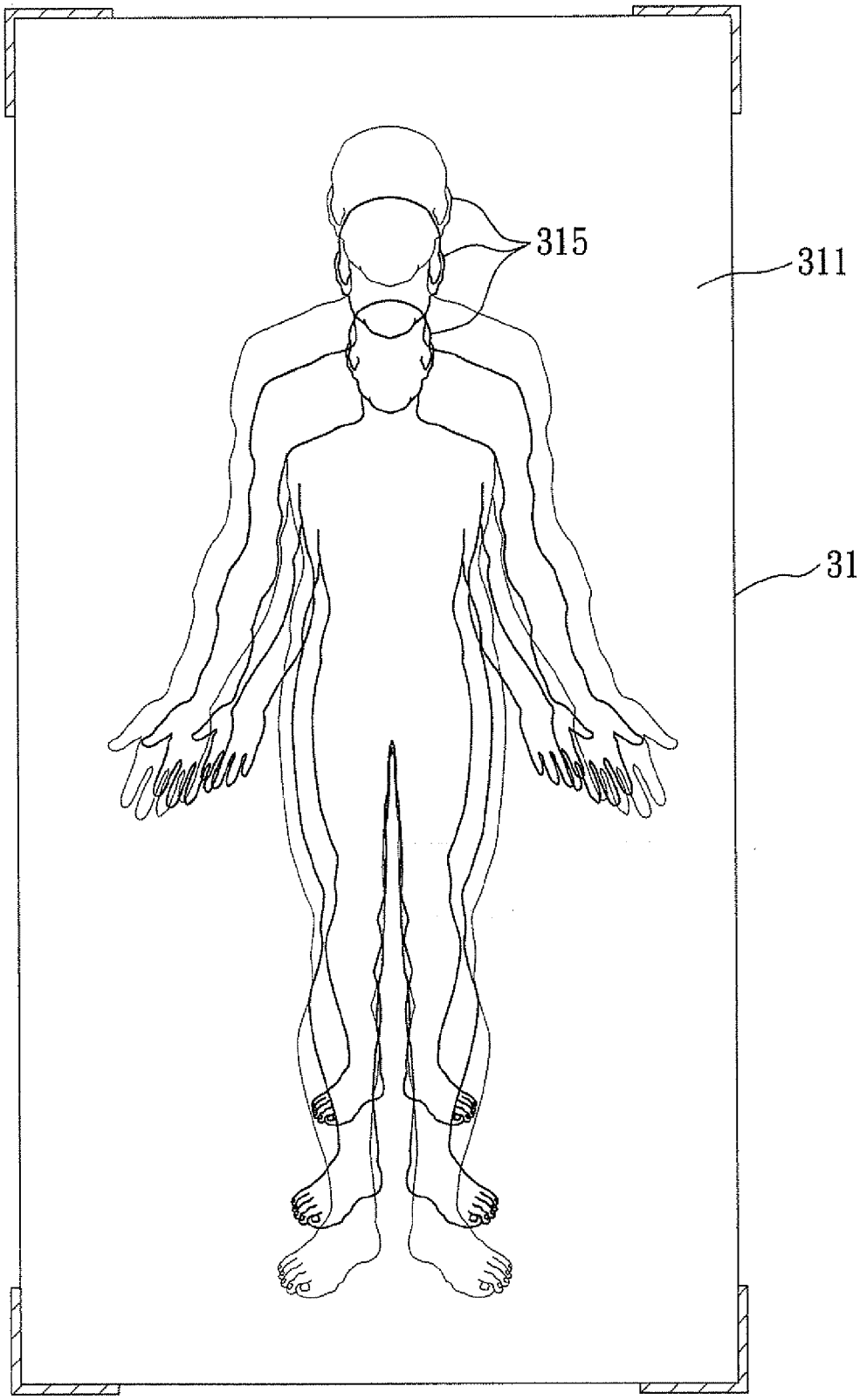
FIG. 9 is a schematic top view showing a modified bed body of the preferred embodiment.

The bed unit 3 has a main frame 32, and a rectangular bed body 31 mounted on the main frame 32. In this embodiment, as shown in FIG. 3, the main frame 32 includes four upright leg rods 321 connected to four corners of the bed body 31, respectively, two elongate first connecting rods 322 opposite to each other in a transverse direction (X) and each interconnecting top ends of two corresponding ones of the leg rods 321, and two elongate second connecting rods 323 opposite to each other in a longitudinal direction (Y) perpendicular to the transverse direction (X) and each interconnecting top ends of two corresponding ones of the leg rods 321. In this embodiment, the bed body 31 has a top surface 311 patterned with a body outline 312, as shown in FIG. 3. In other embodiments, the top surface 311 of the bed body 31 can be patterned with a plurality of various body outlines 315, as shown in FIG. 9.

The main frame 32 further includes a first guiding rail unit 33, a second guiding rail unit 34, a mounting seat 35, and a post 36.

The first guiding rail unit 33 is disposed above the bed body 31 and under the first connecting rods 322, and has opposite elongate lateral rail rods 331 spaced apart from each other in the transverse direction (X), as shown in FIG. 3.

Figure 5:
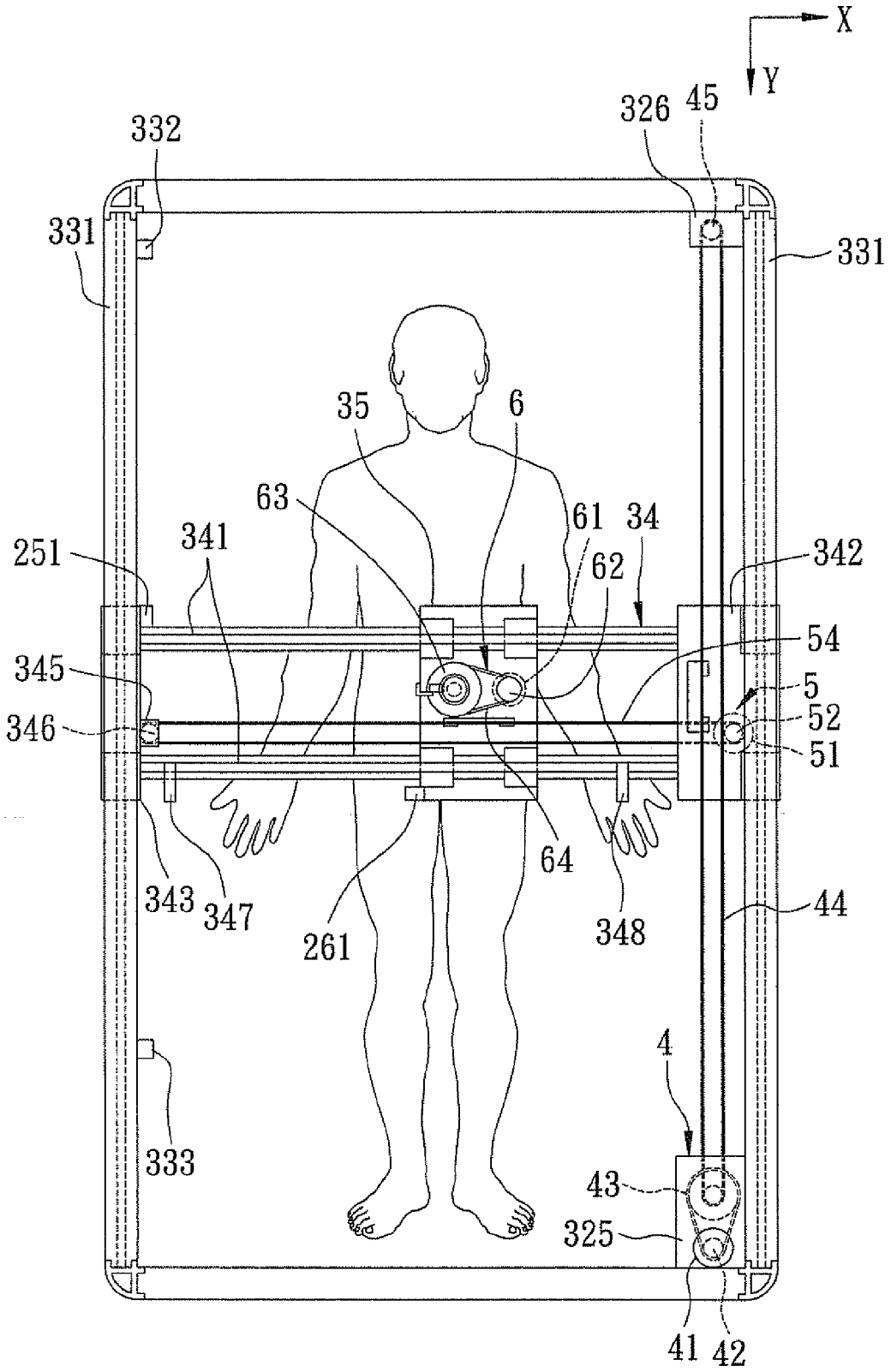
FIG. 5 is a schematic top view showing the preferred embodiment.
Figure 6:
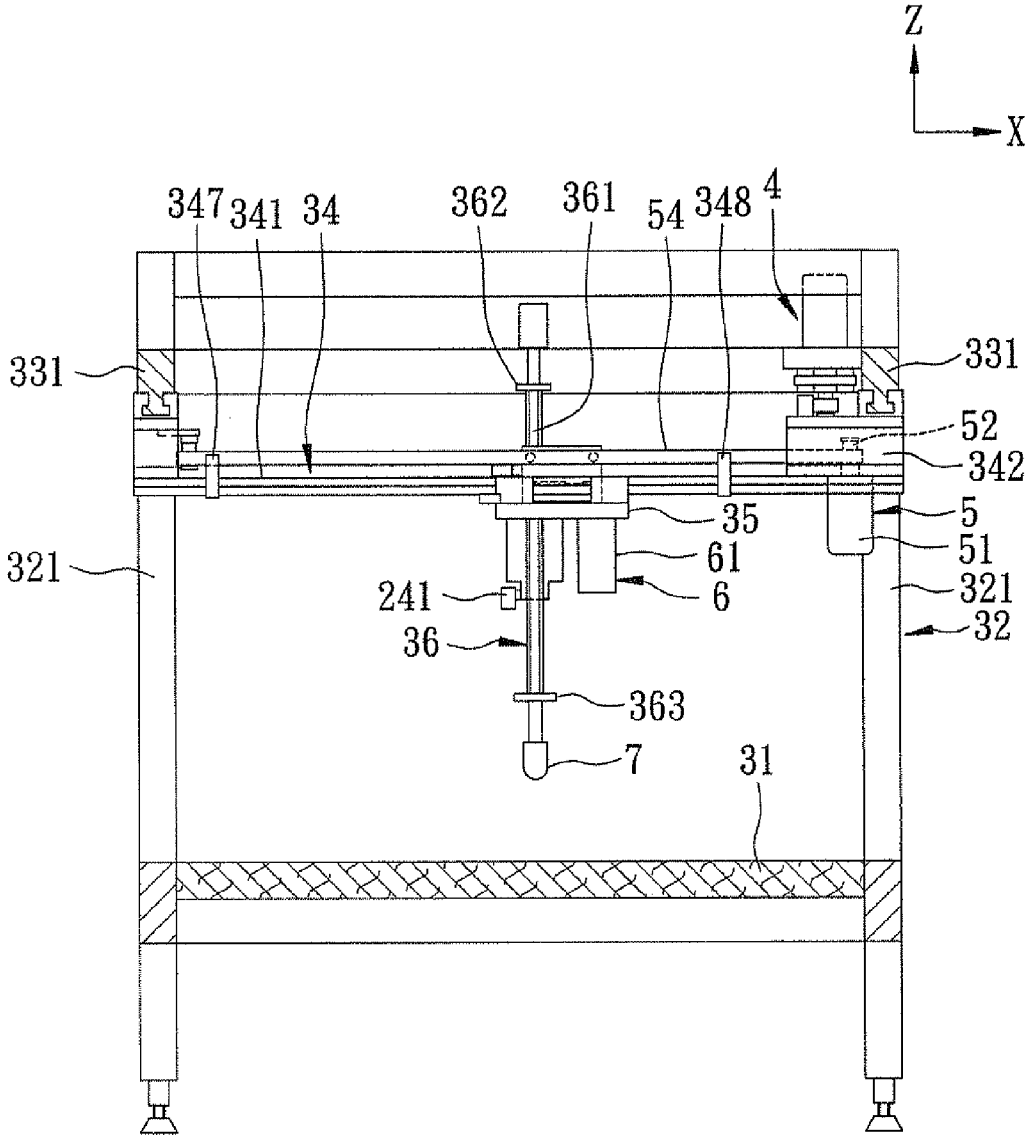
FIG. 6 is a partly sectional, schematic rear view showing the preferred embodiment.

As best shown in FIGS. 5 and 6, the second guiding rail unit 34 is disposed under and is mounted slidably on the first guiding rail unit 33. The second guiding rail unit 34 includes two parallel elongate second rail rods 341 that extend between the lateral rail rods 331 of the first guiding rail unit 33 and that are spaced apart from each other in the longitudinal direction (Y), and two opposite sliding blocks 342, 343 each interconnecting corresponding ends of the second rail rods 341 and connected slidably to a corresponding one of the lateral rail rods 331 of the first guiding rail unit 33.

Figure 7:
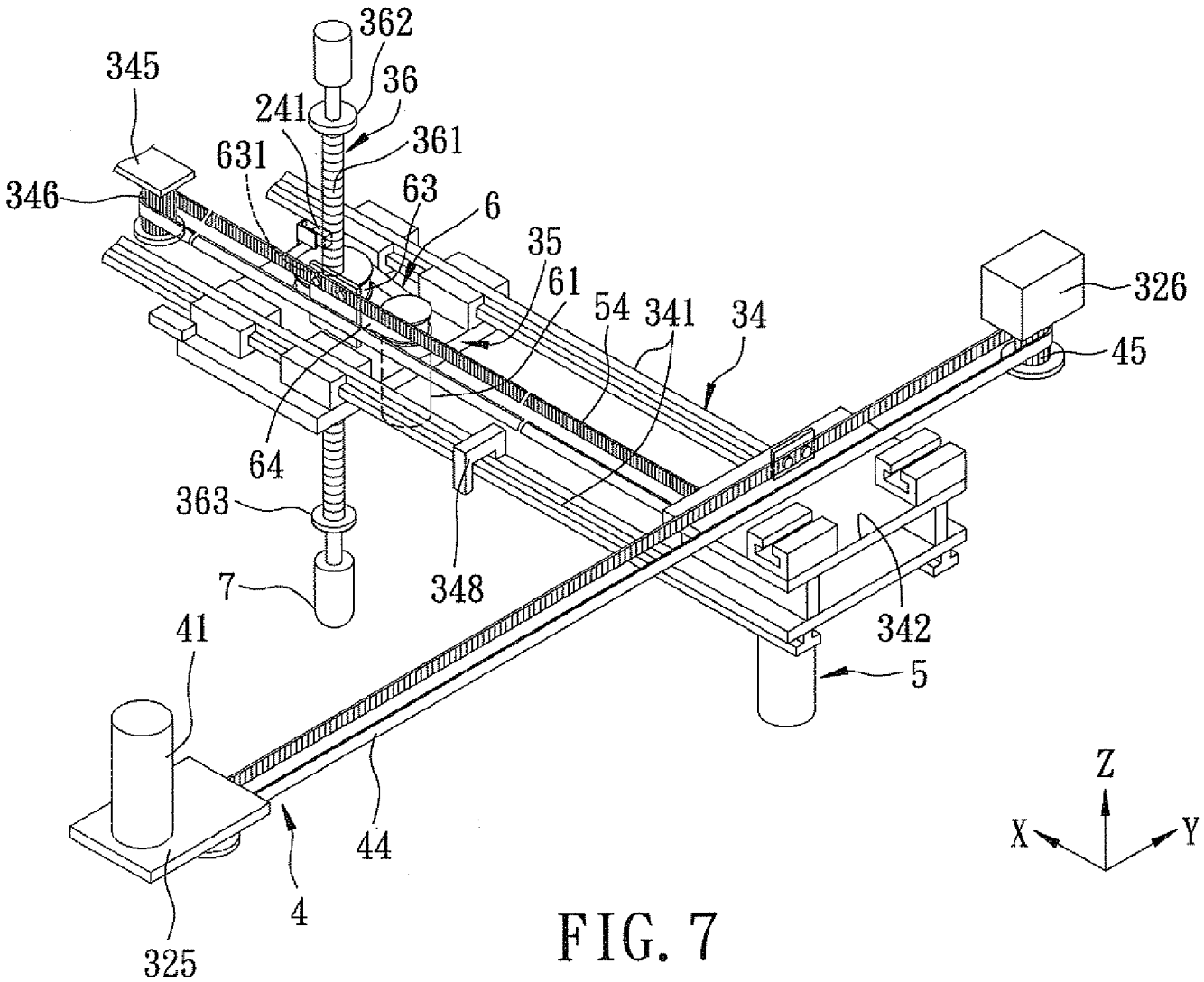
FIG. 7 is a fragmentary perspective view showing a first guiding rail unit, the second guiding rail unit, the mounting seat, the post, and first to third drive units of the preferred embodiment.

The mounting seat 35 is disposed under and is mounted slidably on the second rail rods 341 of the second guiding rail unit 34, as best shown in FIG. 7.

Referring further to FIG. 7, the post 36 extends through and is mounted movably on the mounting seat 35 such that the post 36 is movable relative to the mounting seat 35 in a vertical direction (Z) perpendicular to the transverse direction (X) and the longitudinal direction (Y). The post 36 has a bottom end provided with a massage member 7 that is adapted to contact a user's body 9 lying on the bed body 31 (see FIG. 4). In this embodiment, the post 36 has a threaded intermediate rod portion 361 extending through the mounting seat 35, and is formed with an annular upper flange 362 extending radially and outwardly therefrom and disposed above the mounting seat 35, and an annular lower flange 363 extending radially and outwardly therefrom and disposed under the mounting seat 35.

The first drive unit 4 is mounted on the main frame 32 of the bed unit 3 for driving the second guiding rail unit 34 to move along the lateral rail rods 331 of the first guiding rail unit 33 in the longitudinal direction (Y). In this embodiment, the first drive unit 4 includes a bi-directional motor 41, a transmission wheel set 43, and a looped first transmission belt 44. The bi-directional motor 41 is connected electrically to and is controlled by the control unit 8, and has a motor shaft 42 journalled on a horizontal plate 325 of the main frame 32. The transmission wheel set 43 is disposed rotatably on the horizontal plate 325, and is rotatable in response to operation of the bi-directional motor 41. The looped transmission belt 44 is trained on the transmission wheel set 43, and on a rod 45 disposed opposite to the transmission wheel set 43 in the longitudinal direction (Y) and mounted on a mounting block 326 of the main frame 32 (see FIG. 7). The sliding block 342 of the second guiding rail unit 34 is attached to and is co-movable with a portion of the looped transmission belt 44.

The second drive unit 5 is mounted on the second guiding rail unit 34 for driving the mounting seat 35 to move along the second rail rods 341 in the transverse direction (X). In this embodiment, the second drive unit 5 includes a bi-directional motor 51 and a looped transmission belt 54. The bi-directional motor 51 is connected electrically to and is controlled by the control unit 8, and has a motor shaft 52 journalled on the sliding block 342 of the second guiding rail unit 34. The looped transmission belt 54 is trained on the motor shaft 52 of the bi-directional motor 51, and on a rod 346 disposed opposite to the second motor shaft 52 in the transverse direction (X) and mounted on an extension 345 of the sliding block 343 of the second guiding rail unit 34 (see FIG. 8). The mounting seat 35 is attached to and is co-movable with the looped transmission belt 54.

The third drive unit 6 is mounted on the mounting seat 35 for driving the post 36 to move in the vertical direction (Z). In this embodiment, the third drive unit 6 includes a bi-directional motor 61, a transmission wheel 63 and a looped transmission belt 64. The bi-directional motor 61 is connected electrically to and is controlled by the control unit 8, and has a motor shaft 62 journalled on the mounting seat 35. The transmission wheel 63 is disposed rotatably on the mounting seat 35, and is formed with a central threaded hole 631 therethrough that engages the threaded intermediate rod portion 361 of the post 36. The looped transmission belt 64 is trained on the transmission wheel 63 and the motor shaft 62 of the bi-directional motor 61.

The memory unit 21 is connected electrically to the control unit 8.

The operating unit 22 is connected electrically to the control unit 8, and is operable so as to output a control signal to the control unit 8. The control signal is correlated with desired treatment procedure for the user to be massaged. The desired treatment procedure includes acupuncture point information and massage pressure information.

The control unit 8 receives the control signal from the operating unit 22, and stores the acupuncture point information and the massage pressure information in the memory unit 21.

The control unit 8 is connected electrically to and controls the bi-directional motors 41, 51, 61 of the first, second and third drive units 4, 5, 6 so as to drive movement of the second guiding rail unit 34 in the longitudinal direction (Y), movement of the mounting seat 35 in the transverse direction (X), and movement of the post 36 in the vertical direction (Z) based on the acupuncture point information read from the memory unit 21 such that the massage member 7 is moved to contact the user's body at a desired acupuncture point corresponding to the acupuncture point information.

After the massage member 7 contacts the user's body 9, the control unit 8 further controls the third drive unit 6 so as to drive further downward movement of the post 36 based on the massage pressure information read from the memory unit 21, thereby pressing the massage member 7 against the user's body at the desired acupuncture point, and controls the first and second drive units 4, 5 so as to drive movement of the massage member 7 around the desired acupuncture point over the user's body such that the user's body is massaged by the massage member 7 with a desired massage pressure corresponding to the further downward movement of the post 7.

The first switch unit 24 is connected electrically to the control unit 8. The first switch unit 24 includes two position-limiting switches 241 (i.e., an upper one is shown in FIG. 7, and a lower one is shown in FIG. 6) corresponding respectively to the annular upper flange 362 and the annular lower flange 363 of the post 36, mounted on the mounting seat 35, and disposed adjacent to the post 36 such that one of the position-limiting switches 241 corresponding to the annular upper flange 362 is activated by the annular upper flange 362 so as to notify the control unit 8 to deactivate the third drive unit 6 when the post 36 is moved downwardly to a predetermined lowermost position, and that the other one of the position-limiting switches 241 corresponding to the annular lower flange 363 is activated by the annular lower flange 363 so as to notify the control unit 8 to deactivate the third drive unit 6 when the post 36 is moved upwardly to a predetermined uppermost position. Hence, the post 36 is limited to move in the vertical direction (Z) between the predetermined uppermost position and the predetermined lowermost position.

Figure 8:
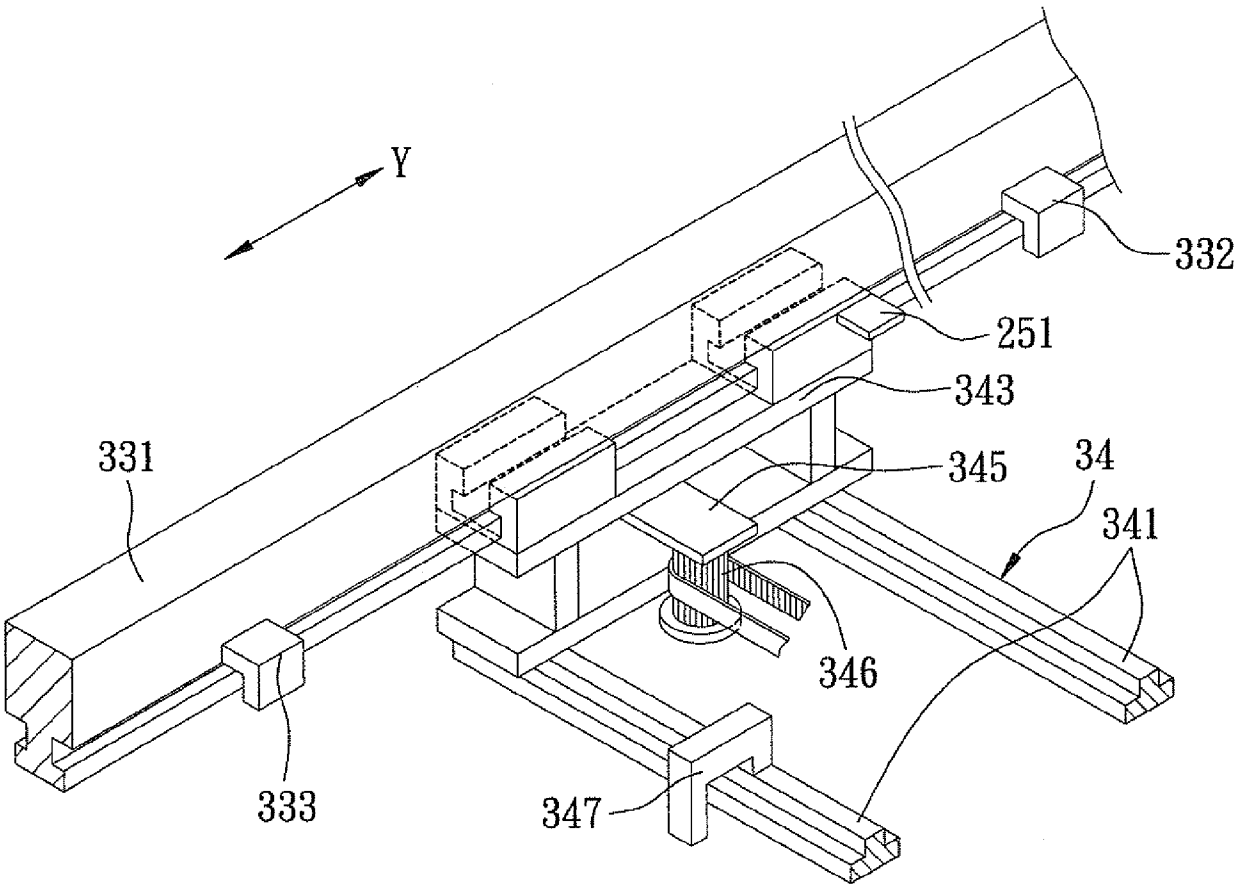
FIG. 8 is a fragmentary perspective view showing the first guiding rail unit and the second guiding rail unit of the preferred embodiment.

In this embodiment, one of the lateral rail rods 331 of the first guiding rail unit 33 is provided with front and rear position-limiting blocks 332, 333 spaced apart from each other in the longitudinal direction (Y), as shown in FIG. 8, and adapted to be disposed respectively adjacent to head and feet of the user's body. In this embodiment, the second switch unit 25 is connected electrically to the control unit 8, and includes a position-limiting switch 251 mounted on the sliding block 343 of the second guiding rail unit 34 and disposed adjacent to said one of the lateral rail rods 331 of the first guiding rail unit 33 such that the position-limiting switch 251 is activated by the front position-limiting block 332 so as to notify the control unit 8 to deactivate the first drive unit 4 when the second guiding rail unit 34 is moved frontwardly to a predetermined frontmost position, and is activated by the rear position-limiting block 333 so as to notify the control unit 8 to deactivate the first drive unit 4 when the second guiding rail unit 34 is moved rearwardly to a predetermined rearmost position. Hence, the second guiding rail unit 34 is limited to move in the longitudinal direction (Y) between the predetermined frontmost position and the predetermined rearmost position.

In this embodiment, one of the second rail rods 341 of the second guiding rail unit 34 is provided with left and right position-limiting blocks 347, 348 spaced apart from each other in the transverse direction (X), as shown in FIG. 5. In this embodiment, the third switch unit 26 is connected electrically to the control unit 8, and includes a position-limiting switch 261 mounted on the mounting seat 35 and disposed adjacent to said one of the second rail rods 341 of the second guiding rail unit such that the position-limiting switch 261 is activated by the left position-limiting block 347 so as to notify the control unit 8 to deactivate the second drive unit 5 when the mounting seat 35 is moved leftwardly to a predetermined leftmost position, and is activated by the right position-limiting block 348 so as to notify the control unit 8 to deactivate the second drive unit 5 when the mounting seat 35 is moved rightwardly to a predetermined rightmost position. Hence, the mounting seat 35 is limited to move in the transverse direction (X) between the predetermined leftmost position and the predetermined rightmost position.

In sum, by controlling the first, second and third drive units 4, 5, 6, the massage member 7 is movable in the transverse, longitudinal and vertical directions (X, Y, Z) so as to contact the user's body at various acupuncture points, thereby resulting in a relatively wide massage area as compared to the abovementioned conventional massage chair.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A massaging apparatus comprising:

a bed unit having a main frame, and a rectangular bed body mounted on said main frame, said main frame including a first guiding rail unit disposed above said bed body and having opposite elongate lateral rail rods spaced apart from each other in a transverse direction, a second guiding rail unit mounted slidably on said first guiding rail unit and including two parallel elongate second rail rods that extend between said lateral rail rods of said first guiding rail unit and that are spaced apart from each other in a longitudinal direction perpendicular to the transverse direction, a mounting seat mounted slidably on said second rail rods of said second guiding rail unit, and a post extending through and mounted movably on said mounting seat such that said post is movable relative to said mounting seat in a vertical direction perpendicular to the transverse direction and the longitudinal direction, said post having a bottom end provided with a massage member that is adapted to contact a user's body lying on said bed body;

a first drive unit mounted on said main frame of said bed unit for driving said second guiding rail unit to move along said lateral rail rods in the longitudinal direction;

a second drive unit mounted on said second guiding rail unit for driving said mounting seat to move along said second rail rods in the transverse direction;

a third drive unit mounted on said mounting seat for driving said post to move in the vertical direction; and a control unit connected electrically to said first, second and third drive units, and controlling said first, second and third drive units so as to drive movement of said second guiding rail unit in the longitudinal direction, movement of said mounting seat in the transverse direction, and movement of said post in the vertical direction such that said massage member is moved to contact the user's body at a desired acupuncture point;

wherein, after said massage member contacts the user's body, said control unit further controls said third drive unit so as to drive further downward movement of said post, thereby pressing said massage member against the user's body at the desired acupuncture point, and controls said first and second drive units so as to drive movement of said massage member around the desired acupuncture point over the user's body such that the user's body is massaged by said massage member with desired massage pressure corresponding to further downward movement of said post.

2. The massaging apparatus as claimed in claim 1, further comprising:

a memory unit connected electrically to said control unit; and an operating unit connected electrically to said control unit and operable so as to output a control signal to said control unit, the control signal being correlated with a desired treatment procedure for the user, the desired treatment procedure including acupuncture point information and massage pressure information;

said control unit receiving the control signal from said operating unit and storing the acupuncture point information and the massage pressure information in said memory unit;

said control unit controlling said first, second and third drive units so as to drive said second guiding rail unit, said mounting seat and said post to thereby move said massage member to contact the user's body at the desired acupuncture point based on the acupuncture point information read from said memory unit, and thereafter further controlling said third drive unit to drive the further downward movement of said post based on the massage pressure information read from said memory unit.

3. The massaging apparatus as claimed in claim 1, wherein:

said second guiding rail unit further includes two opposite sliding blocks each interconnecting corresponding ends of said second rail rods and connected slidably to a corresponding one of said lateral rail rods of said first guiding rail unit; and said first drive unit includes a bi-directional motor connected electrically to and controlled by said control unit, and having a motor shaft journalled on said main frame, a transmission wheel set disposed rotatably on said main frame and rotatable in response to operation of said bi-directional motor, and a looped transmission belt trained on said transmission wheel set and connected to one of said sliding blocks of said second guiding rail unit.

4. The massaging apparatus as claimed in claim 3, wherein said second drive unit includes a bi-directional motor connected electrically to and controlled by said control unit, and having a motor shaft journalled on one of said sliding blocks of said second guiding rail unit, and a looped transmission belt trained on said motor shaft of said bi-directional motor of said second drive unit and connected to said mounting seat.

5. The massaging apparatus as claimed in claim 1, wherein:

said third drive unit includes a bi-directional motor connected electrically to and controlled by said control unit, and having a motor shaft journalled on said mounting seat, a transmission wheel disposed rotatably on said mounting seat and formed with a central threaded hole therethrough, and a looped transmission belt trained on said transmission wheel and said motor shaft of said bi-directional motor of said third drive unit; and said post has a threaded intermediate rod portion extending through said mounting seat and engaging said threaded hole in said transmission wheel.

6. The massaging apparatus as claimed in claim 1, wherein said post is formed with an annular upper flange extending radially and outwardly there from and disposed above said mounting seat, and an annular lower flange extending radially and outwardly there from and disposed under said mounting seat, said massaging apparatus further comprising two position-limiting switches corresponding respectively to said annular upper flange and said annular lower flange, connected electrically to said control unit, mounted on said mounting seat, and disposed adjacent to said post such that one of said position-limiting switches corresponding to said annular upper flange is activated by said annular upper flange so as to notify said control unit to deactivate said third drive unit when said post is moved downwardly to a predetermined lowermost position, and that the other one of said position-limiting switches corresponding to said annular lower flange is activated by said annular lower flange so as to notify said control unit to deactivate said third drive unit when said post is moved upwardly to a predetermined uppermost position.

7. The massaging apparatus as claimed in claim 1, wherein one of said lateral rail rods of said first guiding rail unit is provided with front and rear position-limiting blocks spaced apart from each other in the longitudinal direction and adapted to be disposed respectively adjacent to head and feet of the user's body, said massaging apparatus further comprising a position-limiting switch connected electrically to said control unit, mounted on said second guiding rail unit, and disposed adjacent to said one of said lateral rail rods of said first guiding rail unit such that said position-limiting switch is activated by said front position-limiting block so as to notify said control unit to deactivate said first drive unit when said second guiding rail unit is moved frontwardly to a predetermined frontmost position, and is activated by said rear position-limiting block so as to notify said control unit to deactivate said first drive unit when said second guiding rail unit is moved rearwardly to a predetermined rearmost position.

8. The massaging apparatus as claimed in claim 1, wherein one of said second rail rods of said second guiding rail unit is provided with left and right position-limiting blocks spaced apart from each other in the transverse direction, said massaging apparatus further comprising a position-limiting switch connected electrically to said control unit, mounted on said mounting seat, and disposed adjacent to said one of said second rail rods of said second guiding rail unit such that said position-limiting switch is activated by said left position-limiting block so as to notify said control unit to deactivate said second drive unit when said mounting seat is moved leftwardly to a predetermined leftmost position, and is activated by said right position-limiting block so as to notify said control unit to deactivate said second drive unit when said mounting seat is moved rightwardly to a predetermined rightmost position.

9. The massaging apparatus as claimed in claim 1, wherein said bed body of said bed unit has a top surface patterned with a plurality of various body outlines.

* * * * *